US006560414B2

(12) United States Patent
Suda et al.

(10) Patent No.: US 6,560,414 B2
(45) Date of Patent: May 6, 2003

(54) REUSABLE PHOTORECEPTOR AND IMAGE FORMING APPARATUS USING THE REUSABLE PHOTORECEPTOR AND METHOD OF REUSING PHOTORECEPTOR

(75) Inventors: Takeo Suda, Tokyo (JP); Takeshi Saitou, Hachiohji (JP); Masaki Narita, Tokyo (JP); Shinji Nagatsuna, Tokyo (JP); Kenichi Shishido, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/988,996

(22) Filed: Nov. 21, 2001

(65) Prior Publication Data

US 2002/0090221 A1 Jul. 11, 2002

(30) Foreign Application Priority Data

Nov. 21, 2000 (JP) ..... 2000-353811
Oct. 16, 2001 (JP) ..... 2001-318180

(51) Int. Cl.[7] ..... G03G 15/00

(52) U.S. Cl. ..... 399/12; 29/895.1; 156/94; 399/26; 399/109

(58) Field of Search ..... 399/12, 24–26, 399/109, 159; 29/895.1; 156/94

(56) References Cited

U.S. PATENT DOCUMENTS 3,680,341 A * 8/1972 Finn, Jr.
5,400,630 A * 3/1995 Okumura et al. ..... 29/895.1

FOREIGN PATENT DOCUMENTS

| | | |
|---|---|---|
| JP | 5-341537 | 12/1993 |
| JP | 6-076140 | 3/1994 |
| JP | 6-186763 | 7/1994 |
| JP | 9-062016 | 3/1997 |
| JP | 2000-147796 | 5/2000 |

* cited by examiner

*Primary Examiner*—William J. Royer
(74) *Attorney, Agent, or Firm*—Oblon, Spivak, McClelland, Maier & Neustadt, P.C.

(57) ABSTRACT

In a photoreceptor for an image forming apparatus including a charging device, a relationship between a thickness "A" of a surface portion of a photosensitive layer abraded by image forming operations, a thickness "B" of a portion of the photosensitive layer ground by an operation of grinding the abraded surface of the photosensitive layer, a number of times "n" the operation of grinding the abraded surface of the photosensitive layer has been executed, and an original photosensitive layer thickness "C" of the photoreceptor is set such that a thickness "D" of a remaining portion of the photosensitive layer after having been ground which is obtained by equation: $D=C-[(A+B)\times n+A]$, is equal to or greater than a thickness of the photosensitive layer in which leakage from the charging device to the photoreceptor does not occur, so that the photoreceptor may be reused.

30 Claims, 4 Drawing Sheets

REUSABLE PHOTORECEPTOR AND IMAGE FORMING APPARATUS USING THE REUSABLE PHOTORECEPTOR AND METHOD OF REUSING PHOTORECEPTOR

BACKGROUND OF THE INVENTION

1. Field of the Invention

The present invention relates to a photoreceptor reused by grinding an abraded surface of the photoreceptor, and an electrophotographic image forming apparatus, such as a copying machine, a printer, a facsimile machine, etc. using the reusable photoreceptor.

2. Discussion of the Background

With use of an electrophotographic photoreceptor (hereinafter simply referred to as a photoreceptor), a photosensitive layer of the photoreceptor is abraded by a cleaning blade in contact with the photoreceptor and by developer on a developing roller. In addition, a film of toner, a paper powder of a recording sheet, etc. typically adheres to the surface of the photoreceptor.

When the photosensitive layer of the photoreceptor is abraded by the cleaning blade and the developer on the developing roller, a surface roughness of the photoreceptor increases, resulting in deteriorating cleaning performance. When a film of toner, a paper powder of a recording sheet, etc. adheres to the surface of the photoreceptor, the film absorbs moisture, resulting in deteriorating developing performance.

In order to prevent a failure condition such as the deterioration of cleaning and developing performance, a predetermined useful lifetime is set for the photoreceptor. Although photoreceptors used until the end of their useful lifetimes have in the past simply been disposed, such photoreceptors are also now getting recycled for reuse in view of environmental benefits.

When an image forming apparatus employs an electrophotographic image forming process cartridge in which a photoreceptor, a developing device, a cleaning device, etc. are integrally accommodated in a case for a compact design and an easy maintenance, a proportion of the cost of the photoreceptor is relatively great in the electrophotographic image forming process cartridge. Therefore, also in view of reuse of the electrophotographic image forming process cartridge, providing a reusable photoreceptor is economically beneficial.

With regard to background techniques of reusing a photoreceptor, a method of reusing a photoreceptor by dissolving, cutting, or peeling a photosensitive layer of the photoreceptor has been proposed. The photosensitive layer is formed on a substrate of the photoreceptor. Further, another method of reusing a photoreceptor by grinding a surface of a photoreceptor has been proposed.

In the background technique of reusing a photoreceptor by dissolving, cutting, or peeling a photosensitive layer of the photoreceptor, it is necessary to re-form the photosensitive layer. In view of a recycled photoreceptor, the costs of collecting the photoreceptor and removing the photosensitive layer of the photoreceptor are added, resulting in increasing manufacturing costs.

In the another background technique of reusing a photoreceptor by grinding a surface of a photoreceptor, leakage from a device, such as a charging device, a transfer device, and a developing device to which a bias voltage is applied, to the photoreceptor typically occurs depending on a thickness of a remaining portion of the photosensitive layer after having been ground. The leakage to the photoreceptor results in deterioration of image quality.

The conditions of using photoreceptors vary depending on an image forming apparatus in which the photoreceptor is provided, and depending on users. Therefore, a condition of the photoreceptor when the photoreceptor is collected after judgement of an end of its useful lifetime varies. As a result, a condition for reuse of a photoreceptor and a method of reusing the photoreceptor depend on the condition of the photoreceptor when the photoreceptor is collected.

SUMMARY OF THE INVENTION

According to one aspect of the present invention, a novel photoreceptor for an image forming apparatus including a charging device that charges a surface of the photoreceptor, includes a photosensitive layer and a substrate on which the photosensitive layer is formed, wherein assuming that "A" is a thickness of a surface portion of the photosensitive layer abraded by image forming operations of the image forming apparatus, "B" is a thickness of a portion of the photosensitive layer ground by an operation of grinding the abraded surface of the photosensitive layer, "n" is a number of times the operation of grinding the abraded surface of the photosensitive layer has been executed, "C" is an original photosensitive layer thickness of the photoreceptor, and "D" is a thickness of a remaining portion of the photosensitive layer after having been ground by the operation of grinding the abraded surface of the photosensitive layer which is obtained by the equation:

$$D=C-[(A+B)\times n+A],$$

a relationship between the thickness "A", the thickness "B", the number of times "n", and the original photosensitive layer thickness "C" is set such that the thickness "D" is equal to or greater than a thickness of the photosensitive layer in which leakage from the charging device to the photoreceptor does not occur, so that the photoreceptor may be reused.

According to another aspect of the present invention, a novel method of reusing a photoreceptor for an image forming apparatus including a charging device that charges a surface of the photoreceptor, includes grinding an abraded surface of a photosensitive layer of the photoreceptor, obtaining a thickness of a remaining portion of the photosensitive layer after having been grounded by the operation of grinding the abraded surface of the photosensitive layer by the equation:

$$D=C-[(A+B)\times n+A],$$

where "A" is a thickness of a surface portion of the photosensitive layer abraded by image forming operations of the image forming apparatus, "B" is a thickness of a portion of the photosensitive layer ground by an operation of grinding the abraded surface of the photosensitive layer, "n" is a number of times the operation of grinding the abraded surface of the photosensitive layer has been executed, "C" is an original photosensitive layer thickness of the photoreceptor, and "D" is a thickness of a remaining portion of the photosensitive layer after having been ground by the operation of grinding the abraded surface of the photosensitive layer, and setting a relationship between the thickness "A", the thickness "B", the number of times "n", and the original photosensitive layer thickness "C" such that the thickness "D" is equal to or greater than a thickness of the photosensitive layer in which leakage from the charging device to the photoreceptor does not occur.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
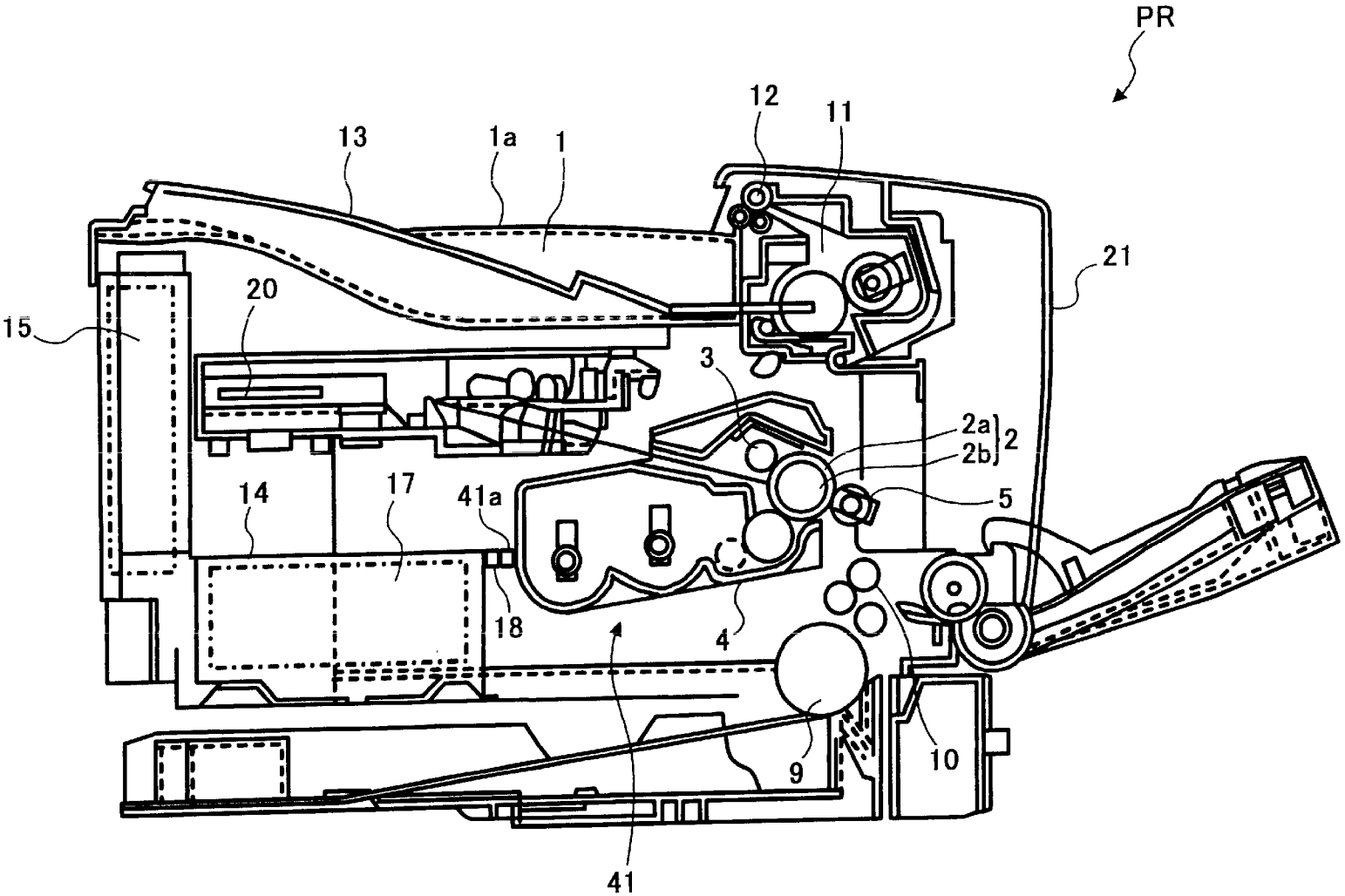
FIG. 1 is a schematic view of an overall structure of a laser printer serving as an image forming apparatus according to an embodiment of the present invention.

Preferred embodiments of the present invention are described in detail referring to the drawings, wherein like reference numerals designate identical or corresponding parts throughout the several views.

FIG. 1 is a schematic view of an overall structure of a laser printer PR serving as an example of an image forming apparatus according to an embodiment of the present invention. In a main body case 1 of the laser printer PR, a photoreceptor 2 is provided at a substantially center part of the laser printer PR. As illustrated in FIG. 1, the photoreceptor 2 includes a photosensitive layer 2*a* and a substrate 2*b* on which the photosensitive layer 2*a* is formed. Arranged around the photoreceptor 2 are a charging device 3, a developing device 4, a transfer device 5, a cleaning device (not shown), etc. An electrophotographic image forming process cartridge 41 (hereinafter simply referred to as a process cartridge 41) integrally accommodates the photoreceptor 2, the charging device 3, the developing device 4, the transfer device 5, the cleaning device, etc.

Provided below the process cartridge 41 are a sheet feeding roller 9 that feeds recording sheets one by one, and a pair of registration rollers 10 that convey the recording sheets fed by the sheet feeding roller 9 toward the transfer device 5 at a predetermined timing. Provided above the process cartridge 41 are a fixing device 11 that fixes an image transferred onto the recording sheet by the transfer device 5, and a sheet discharging roller 12 that discharges the recording sheet having a fixed image.

Further, a sheet stacker unit 13 onto which the recording sheets having fixed images are discharged is formed at an upper surface part of a main body cover 1*a* as a part of the main body case 1. Provided below the sheet stacker unit 13 in the main body case 1 is an electrical component unit 15. The electrical component unit 15 includes an ECB (engine controller board) 43 (illustrated in FIGS. 4 through 6), a controller base board (not shown), various kinds of adjustment switches (not shown), and a control unit (not shown) mounted on the controller base board.

A case 14 in the main body case 1 accommodates a power supply 17 and an electrical parts mounting base board (not shown). Further, provided above the case 14 is an optical device 20 that writes an image on the photoreceptor 2. Moreover, a front cover 21 is provided at a part of the main body case 1 (e.g. at a right-hand side of the main body case 1 in FIG. 1). The transfer device 5 is attached to the front cover 21. The front cover 21 is rotatably provided around a part of the main body case 1 as a supporting point, and is configured to be opened for replacing consumables and the fixing device 11 and for removing jammed recording sheets. In this embodiment, the charging device 3, the optical device 20, and the developing device 4 serve as an image forming device that forms a visual image on the photoreceptor 2.

Figure 2:
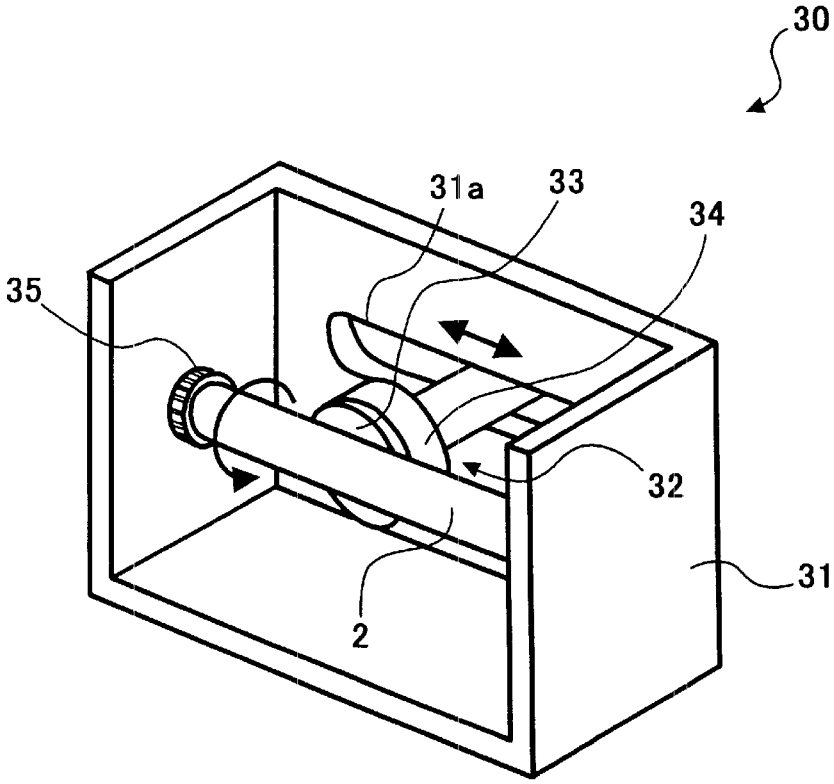
FIG. 2 is a schematic perspective view of a photoreceptor grinding device according to the embodiment of the present invention.
Figure 3:
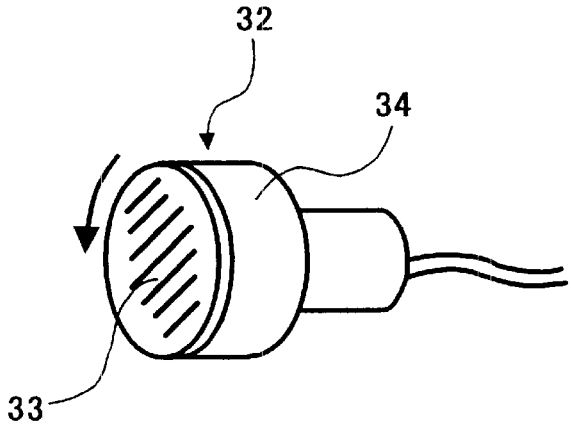
FIG. 3 is a schematic perspective view of a main part of the photoreceptor grinding device of FIG. 2.

FIG. 2 is a schematic perspective view of a photoreceptor grinding device. FIG. 3 is a schematic perspective view of a main part of the photoreceptor grinding device of FIG. 2.

As illustrated in FIG. 2, a photoreceptor grinding device 30 includes a case 31 and supporting parts (not shown) that support the photoreceptor 2 at both sides of the case 31 such that the photoreceptor 2 is rotatable. A hole 31*a*, e.g. an oblong hole, is provided in the case 31, and a grinding part 32 of the photoreceptor grinding device 30 is configured to be movable in a substantially horizontal direction along the oblong hole 31*a*. As illustrated in FIGS. 2 and 3, the grinding part 32 includes a cylindrical elastic body 34 formed from, for example, a sponge and a grinding pad 33. The grinding pad 33 includes a flat shaped attachment part at one side of the grinding pad 33. The flat shaped attachment part is attached onto one side of the elastic body 34 with a fixing element such as a planar fastener.

A used photoreceptor 2 collected from users is rotatably held by the supporting parts of the case 31 of the photoreceptor grinding device 30. The supporting parts are driven by a motor (not shown) via a gear (not shown) engaged with a flange gear 35 provided at one of the supporting parts, thereby causing the photoreceptor 2 to rotate.

When grinding the photoreceptor 2, the photoreceptor 2 is set in the photoreceptor grinding device 30, and is then ground by the grinding pad 33 abutted against the surface of the photosensitive layer 2*a* of the photoreceptor 2 with a predetermined pressing force. The grinding pad 33 moves at a predetermined speed in the axial direction of the photoreceptor 2 while rotating at a predetermined number of revolutions, thereby grinding at least a width of a part of the photoreceptor 2 corresponding to an image forming area thereof. The grinding pad 33 may perform plural reciprocating motions in the axial direction of the photoreceptor 2.

Grinding conditions such as a pressing force, a number of revolutions of the grinding pad 33, a moving speed, and a number of times of reciprocating motions of the grinding pad 33 in the axial direction of the photoreceptor 2 are set by experiments so that a thickness of a portion of the photosensitive layer 2*a* ground by the operation of grinding the surface of the photosensitive layer 2*a* of the photoreceptor 2 is equal to a predetermined thickness.

For example, the above-described grinding conditions may be set as follows:

a pressing force of the grinding pad 33: $9.8\times10^3$ Pa (100 gf/cm2);

a rotation speed of the grinding pad 33: 60 rpm;

a moving speed of the grinding pad 33: 1 cm/sec;

a number of times of reciprocating motions of the grinding pad 33: one time.

And when the surface of the photosensitive layer 2*a* of the photoreceptor 2 is ground by 5 μm under the above-described grinding conditions, foreign substances such as toner attached onto the used photoreceptor 2 can be removed from the photoreceptor 2, and the surface roughness of the used photoreceptor 2 can be improved from about 4 μm (max) to about 0.5 μm or less. As a result, the photoreceptor 2 exhibits performance substantially similar to a new (i.e., original) photoreceptor.

The present inventors have carried out experiments so that sequential operations of using (i.e., image forming) and grinding the photoreceptor 2 are repeated by use of the process cartridge 41 having a useful lifetime of 10,000 pages and including the photoreceptor 2 having a 33 μm thickness of the photosensitive layer 2*a*. As a result, leakage from the charging device 3 (e.g., a charging roller) to the photoreceptor 2 was found to occur in the fourth use of the photoreceptor 2. Specifically, the thickness of the photosensitive layer 2*a* of the photoreceptor 2 changed as follows:

| | Thickness of photosensitive layer 2a |
|---|---|
| Original: | 33 μm |
| After first use: | 30 μm (i.e., abrasion of 3 μm) |
| After first grinding: | 25 μm (i.e., grinding of 5 μm) |
| After second use: | 22 μm (i.e., abrasion of 3 μm) |
| After second grinding: | 17 μm (i.e., grinding of 5 μm) |
| After third use: | 14 μm (i.e., abrasion of 3 μm) |
| After third grinding: | 9 μm (i.e., grinding of 5 μm) |
| At occurrence of leakage in the fourth use: | 7 μm |

In the above-described experiments, a bias voltage of DC: −750V and AC: 2 kv/1 kHz was applied to the charging device 3. Further, the above-described experiments were carried out on the precondition that the grinding operations were performed two times and that the photoreceptor 2 was used three times in total. Therefore, a failure condition such as leakage was found to occur in the fourth use of the photoreceptor 2.

Another experiment was carried out to determine an occurrence of leakage when a thickness of the photosensitive layer 2*a* of an original photoreceptor 2 was changed. The results of the experiment are as follows:

Photosensitive layer thickness

15 μm: no occurrence

12 μm: no occurrence

10 μm: no occurrence

8 μm: occurrence

6 μm: occurrence

Based on the above-described experiments, it was discovered that when the photoreceptor 2 is used while repeating grinding operations, if a thickness of the photosensitive layer 2*a* of the photoreceptor 2 is 10 μm or greater after using the photoreceptor 2 "n" times, leakage does not occur. Therefore, assuming that "A" is a thickness of a surface portion of the photosensitive layer 2*a* abraded by image forming operations of the laser printer PR, "B" is a thickness of a portion of the photosensitive layer 2*a* ground by an operation of grinding the abraded surface of the photosensitive layer 2*a*, "n" is a number of times the operation of grinding the abraded surface of the photosensitive layer 2*a* was executed, and "C" is an original photosensitive layer thickness of the photoreceptor 2, an occurrence of leakage was found by the inventors to be avoided by satisfying the following condition:

$$C-[(A+B)\times n+A]\geqq 10\ \mu m.$$

In other words, the inventors found, assuming that "D" is a thickness of a remaining portion of the photosensitive layer 2*a* after having been ground by the operation of grinding the abraded surface of the photosensitive layer 2*a* obtained by the following equation:

$$D=C-[(A+B)\times n+A],$$

a relationship between the thickness "A", the thickness "B", the number of times "n", and the original photosensitive layer thickness "C" should be set such that the thickness "D" is equal to or greater than a thickness of the photosensitive layer 2*a* in which leakage from the charging device 3 to the photoreceptor 2 does not occur.

Further, when the useful lifetime of the photoreceptor 2 is diagnosed with reference to the thickness "D", the limit of the reuse of the photoreceptor 2 can be judged. Specifically, an operator and maintenance personnel can judge that the photoreceptor 2 can be reused provided the thickness "D" is equal to or greater than the thickness of the photosensitive layer 2*a* in which leakage from the charging device 3 to the photoreceptor 2 does not occur. Thus, the photoreceptor 2 can be surely reused until the end of its useful lifetime.

Figure 4:
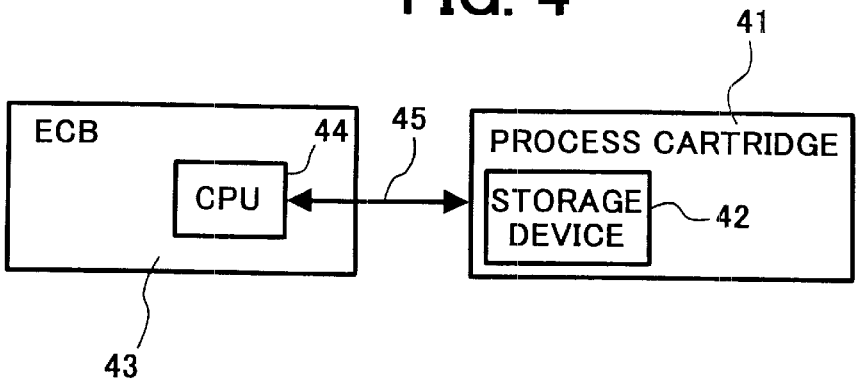
FIG. 4 is a block diagram illustrating an example in which a storage device is provided in a process cartridge.

FIG. 4 is a block diagram illustrating an example in which a storage device is provided in the process cartridge.

As described earlier, in this embodiment, the photoreceptor 2 is integrally accommodated in the process cartridge 41. Further, a storage device 42 is provided to the photoreceptor 2. The storage device 42 is used for storing use historical information of the photoreceptor 2. By use of the use historical information of the photoreceptor 2 stored in the storage device 42, reusing the photoreceptor 2 can be performed efficiently.

Between the storage device 42 and a CPU (central processing unit) 44 serving as a control device provided on the ECB 43 of the electrical component unit 15, a communicating device 45 is provided to transmit information used in the laser printer PR from the CPU 44 to the storage device 42. The transmitted information is written in the storage device 42 as data. Although details will be described later, such information is, for example, "a number of revolutions", "rotational speed×rotation time", "width of recording sheet×a number of recording sheets", and "a number of times of starting rotation" of the photoreceptor 2.

As illustrated in FIG. 1, a terminal 41*a* is provided at a side surface of the process cartridge 41 at a side of the case 14, and a terminal 18 is provided onto the external surface of the case 14. The terminal 41*a* and the terminal 18 connect to each other in order for data to be transmitted from the storage device 42 in the process cartridge 41 to the CPU 44 of the electrical component unit 15, and vice versa, through the case 14 via the communicating device 45.

Figure 5:
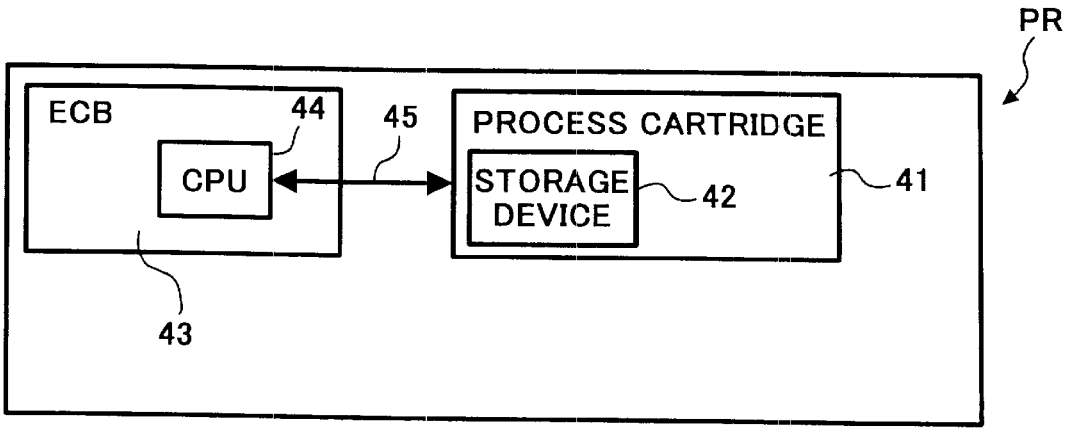
FIG. 5 is a block diagram illustrating an example in which the process cartridge of FIG. 4 is employed in the laser printer of FIG. 1.

FIG. 5 is a block diagram illustrating an example in which the process cartridge 41 of FIG. 4 is employed in the laser printer PR. The laser printer PR of FIG. 5 includes the process cartridge 41 having the storage device 42.

Figure 6:
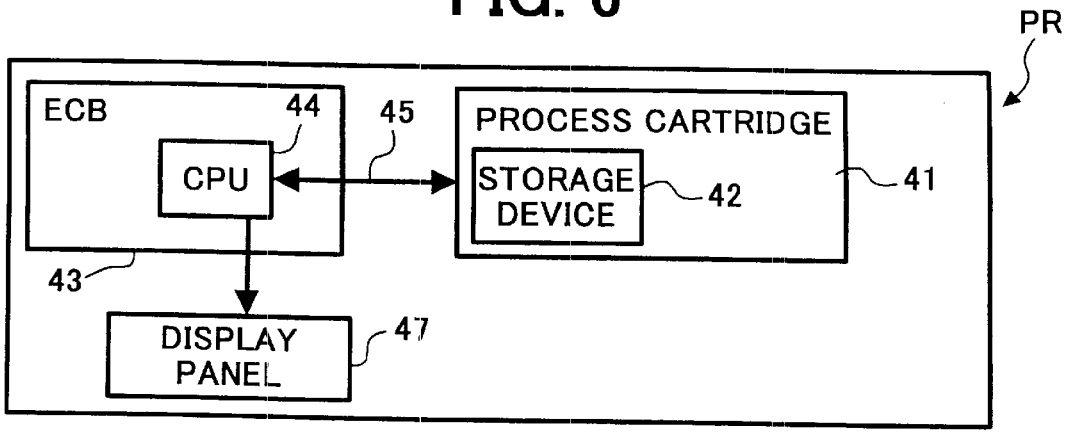
FIG. 6 is a block diagram illustrating another example in which the process cartridge of FIG. 4 is employed in the laser printer of FIG. 1.

FIG. 6 is a block diagram illustrating another example in which the process cartridge 41 of FIG. 4 is employed in the laser printer PR. The laser printer PR of FIG. 6 includes a display panel 47 serving as an informing device in addition to a construction illustrated in FIG. 5. In the laser printer PR of FIGS. 5 and 6, information stored in the storage device 42 provided to the photoreceptor 2 in the process cartridge 41 is read by the CPU 44 via the communicating device 45. Thereafter, information relating to the photoreceptor 2 is added to the information read by the CPU 44. Subsequently, the revised information is further transmitted from the CPU 44 to the storage device 42 and is re-written in the storage device 42.

In the laser printer PR of FIG. 6, the CPU 44 reads information from the storage device 42 and controls the read information data to display on the display panel 47 and to print on a recording sheet. In this condition, an operator and maintenance personnel can judge the condition of the photoreceptor 2 by the display panel 47 and the printed recording sheet.

As one non-limiting alternative, an operator and maintenance personnel can judge the condition of the photoreceptor 2 and the process cartridge 41 by a measuring device. In this case, for example, a used process cartridge 41 is collected, and an operator and maintenance personnel judge if the photoreceptor 2 of the process cartridge 41 is further usable or not based on the information obtained by the measuring device.

Figure 7:
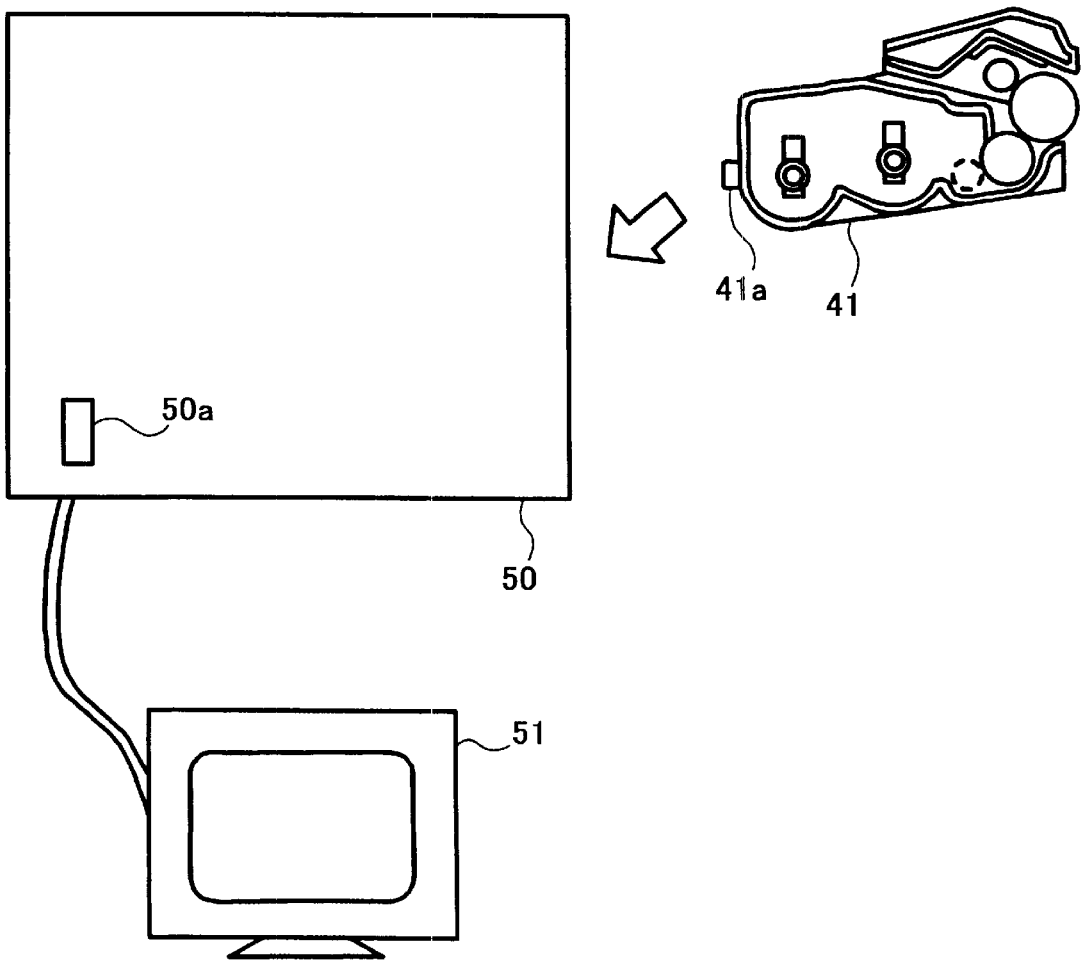
FIG. 7 is a schematic view of a construction in which a terminal provided with the process cartridge is connected to a connection terminal of a connecting device that connects to a personal computer according to the embodiment of the present invention.

Specifically, as illustrated in FIG. 7, the terminal 41*a* provided at the side surface of the process cartridge 41 is connected to a connection terminal 50*a* of a connecting device 50 that connects to a personal computer 51. In the personal computer 51, use historical information of the photoreceptor 2, such as a number of times the operation of grinding the abraded surface of the photoreceptor 2 has been executed, a number of printed sheets, and rotation time of the photoreceptor 2, is read from the storage device 42 in the process cartridge 41 connected to the personal computer 51, and is displayed on a display of the personal computer 51. The grinding conditions for the photoreceptor 2 are set based on the displayed use historical information of the photoreceptor 2 in the personal computer 51. The photoreceptor 2 is then ground under the preset grinding conditions by the grinding device 30.

When the grinding of the photoreceptor 2 is completed, the ground photoreceptor 2 is set in the process cartridge 41. Further, the process cartridge 41 is connected to the connecting device 50, and information, such as a number of times the operation of grinding the abraded surface of the photoreceptor 2 has been executed and a thickness of a remaining portion of the photosensitive layer 2*a* after having been ground, is written in the storage device 42 from the personal computer 51. With the above-described operations, the reusable process cartridge 41 can be offered to users.

The storage device 42 includes, for example, an IC (integrated circuit) chip, an EEPROM (electrically erasable programmable ROM), etc. The IC chip and EEPROM are capable of storing a plurality of pieces of information, and can store a single or plural pieces of information if necessary. The EEPROM stores a single or plural pieces of information if necessary.

One example of the information relating to the photoreceptor 2 stored in the storage device 42 is "a number of revolutions" of the photoreceptor 2. An operating time of the photoreceptor 2 can be judged from the number of revolutions of the photoreceptor 2. Timing of transmitting data to the storage device 42 from the CPU 44 can be arbitrary, such as, during rotations or halts of the photoreceptor 2.

Other than "a number of revolutions" of the photoreceptor 2, "rotational speed×rotation time", "width of recording sheet×a number of recording sheets", "a number of times of starting rotation" of the photoreceptor 2, etc., can be employed as examples of the information relating to the photoreceptor 2 stored in the storage device 42.

Specifically, depending on an image forming apparatus such as the laser printer PR, an image resolution may be changed by changing the rotational speed of the photoreceptor 2. From the above-described "rotational speed× rotation time", the total distance rotated by the photoreceptor 2 can be judged.

Further, the laser printer PR can use recording sheets of several widths. If the information of "width of recording sheets×a number of recording sheets" used in the laser printer PR is stored in the storage device 42, a partial historical used area of the photoreceptor 2 can be judged from the above-described information, although use frequency at a widthwise part (i.e., an axial part) of the photoreceptor 2 varies depending on a width of a recording sheet.

"A number of times of starting rotation" of the photoreceptor 2 means that a number of times of starting rotation of the photoreceptor 2 from a halt. From "a number of times of starting rotation" of the photoreceptor 2 and "total number of printed recording sheets", Print/Job (P/J) can be judged. Specifically, when a one-page document is printed ten times, "a number of times of starting rotation" of the photoreceptor 2 is ten, and a "total number of printed recording sheets" is ten. When ten-page documents are printed one time, "a number of times of starting rotation" of the photoreceptor 2 is one, and a "total number of printed recording sheets" is ten.

Regularly, when rotating the photoreceptor 2, operations for pre-treatment and post-treatment are necessary. Therefore, the photoreceptor 2 rotates for a longer time than an actual printing time. The rotation time of the photoreceptor 2 when a one-page document is printed ten times is longer than when a ten-page document is printed one time. The rotation time of the photoreceptor 2 can be substantially grasped from "a number of times of starting rotation" of the photoreceptor 2 and a "total number of printed recording sheets".

The timing of transmitting data, such as, the above-described "rotational speed×rotation time", "width of recording sheet×a number of recording sheets", and "a number of times of starting rotation" of the photoreceptor 2, to the storage device 42 from the CPU 44 can be arbitrary, such as, during rotations or halts of the photoreceptor 2.

With use of the information stored in the storage device 42, such as "a number of revolutions", "rotational speed× rotation time", "width of recording sheet×a number of recording sheets", and "a number of times of starting rotation" of the photoreceptor 2, the condition of the photoreceptor 2 regarding an amount of its abrasion can be recognized, so that reusing the photoreceptor 2 can be performed efficiently.

Moreover, other information transmitted from the laser printer PR, such as individual information regarding using status of the photoreceptor 2, a serial number, a manufacturing date, etc., of the photoreceptor 2, is stored in the storage device 42. Information in which the above-described other information is combined with the information regarding the process cartridge 41 can be input to the storage device 42. By use of the individual information regarding using status of the photoreceptor 2, e.g. a serial number, a manufacturing date, etc., of the photoreceptor 2 stored in the storage device 42, the photoreceptor 2 can be reused and maintained adequately.

According to the embodiment of the present invention, the photoreceptor 2 is reusable by grinding an abraded surface of the photosensitive layer 2*a*. A thickness of a remaining portion of the photosensitive layer 2*a* after having been ground by an operation of grinding the abraded surface of the photosensitive layer 2*a* is set to be equal to or greater than a thickness of the photosensitive layer 2*a* in which leakage from the charging device 3 to the photoreceptor 2 does not occur, and the photosensitive layer 2*a* is ground by an operation of grinding the abraded surface of the photosensitive layer 2*a* until a thickness of the photosensitive layer 2*a* is equal to a thickness of the photosensitive layer in which leakage from the charging device 3 to the photoreceptor 2 does not occur. Thereby, the photoreceptor 2 can be reused at a low cost.

The present invention has been described with respect to the embodiments illustrated in the figures. However, the present invention is not limited to the embodiments and may be practiced otherwise.

The present invention has been described with respect to a laser printer as an example of an image forming apparatus. However, it is needless to say that the present invention can be applied to other image forming apparatuses, such as a copying machine, a facsimile machine, etc.

Further, in the above-described embodiment, the storage device 42 is provided to the photoreceptor 2. However, as another example the storage device 42 may be provided to the process cartridge 41.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-353811 filed in the Japanese Patent Office on Nov. 21, 2000, and Japanese Patent Application No. 2001-318180 filed in the Japanese Patent Office on Oct. 16, 2001, and the entire contents of each of which are hereby incorporated herein by reference.

What is claimed as new and is desired to be secured by Letters Patent of the United States is:

1. A photoreceptor for an image forming apparatus including a charging device that charges a surface of the photoreceptor, comprising:

a photosensitive layer; and a substrate on which the photosensitive layer is formed, wherein assuming that "A" is a thickness of a surface portion of the photosensitive layer abraded by image forming operations of the image forming apparatus, "B" is a thickness of a portion of the photosensitive layer ground by an operation of grinding the abraded surface of the photosensitive layer, "n" is a number of times the operation of grinding the abraded surface of the photosensitive layer has been executed, "C" is an original photosensitive layer thickness of the photoreceptor, and "D" is a thickness of a remaining portion of the photosensitive layer after having been ground by the operation of grinding the abraded surface of the photosensitive layer which is obtained by equation:

$$D=C-[(A+B)\times n+A],$$

a relationship between the thickness "A", the thickness "B", the number of times "n", and the original photosensitive layer thickness "C" is set such that the thickness "D" is equal to or greater than a thickness of the photosensitive layer in which leakage from the charging device to the photoreceptor does not occur, so that the photoreceptor may be reused.

2. The photoreceptor according to claim 1, wherein the thickness "D" is 10 $\mu$m or greater.

3. The photoreceptor according to claim 1, wherein the photoreceptor is used as a part of an electrophotographic image forming process cartridge in the image forming apparatus.

4. The photoreceptor according to claim 1, further comprising a storage device configured to store information relating to the photoreceptor.

5. The photoreceptor according to claim 4, wherein the storage device includes an EEPROM.

6. The photoreceptor according to claim 4, wherein the storage device includes an IC (integrated circuit) chip.

7. The photoreceptor according to claim 4, wherein the information relating to the photoreceptor includes a rotation time of the photoreceptor.

8. The photoreceptor according to claim 4, wherein the information relating to the photoreceptor includes a (rotational speed×rotation time) of the photoreceptor.

9. The photoreceptor according to claim 4, wherein the information relating to the photoreceptor includes a (width of a recording medium on which an image is formed×a number of recording media on which images are formed).

10. The photoreceptor according to claim 4, wherein the information relating to the photoreceptor includes a number of times of starting rotation of the photoreceptor from a halt.

11. The photoreceptor according to claim 4, wherein the information relating to the photoreceptor includes at least one of a serial number and manufacturing date of the photoreceptor, and individual information transmitted from the image forming apparatus.

12. An image forming apparatus, comprising:

a photoreceptor including a photosensitive layer and a substrate on which the photosensitive layer is formed;

an image forming device configured to form a visual image on the photoreceptor, the image forming device including a charging device configured to uniformly charge a surface of the photoreceptor;

a transfer device configured to transfer the visual image formed on the photoreceptor onto a recording medium; and a fixing device configured to fix the transferred visual image onto the recording medium, wherein assuming that "A" is a thickness of a surface portion of the photosensitive layer abraded by image forming operations of the image forming apparatus, "B" is a thickness of a portion of the photosensitive layer ground by an operation of grinding the abraded surface of the photosensitive layer, "n" is a number of times the operation of grinding the abraded surface of the photosensitive layer has been executed, "C" is an original photosensitive layer thickness of the photoreceptor, and "D" is a thickness of a remaining portion of the photosensitive layer after having been ground by the operation of grinding the abraded surface of the photosensitive layer which is obtained by equation:

$$D=C-[(A+B)\times n+A],$$

a relationship between the thickness "A", the thickness "B", the number of times "n", and the original photosensitive layer thickness "C" is set such that the thickness "D" is equal to or greater than a thickness of the photosensitive layer in which leakage from the charging device to the photoreceptor does not occur, so that the photoreceptor may be reused.

13. The image forming apparatus according to claim 12, wherein the thickness "D" is 10 $\mu$m or greater.

14. The image forming apparatus according to claim 12, further comprising an electrophotographic image forming process cartridge accommodating the photoreceptor.

15. The image forming apparatus according to claim 12, further comprising a storage device configured to store information relating to the photoreceptor provided with the photoreceptor.

16. The image forming apparatus according to claim 15, wherein the storage device includes an EEPROM.

17. The image forming apparatus according to claim 15, wherein the storage device includes an IC (integrated circuit) chip.

18. The image forming apparatus according to claim 15, wherein the information relating to the photoreceptor includes a rotation time of the photoreceptor.

19. The image forming apparatus according to claim 15, wherein the information relating to the photoreceptor includes a (rotational speed×rotation time) of the photoreceptor.

20. The image forming apparatus according to claim 15, wherein the information relating to the photoreceptor includes a (width of a recording medium on which an image is formed×a number of recording media on which images are formed).

21. The image forming apparatus according to claim 15, wherein the information relating to the photoreceptor includes a number of times of starting rotation of the photoreceptor from a halt.

22. The image forming apparatus according to claim 15, wherein the information relating to the photoreceptor includes at least one of a serial number and manufacturing date of the photoreceptor, and individual information transmitted from the image forming apparatus.

23. The image forming apparatus according to claim 15, further comprising a control device configured to read and revise the information stored in the storage device and to feed revised information back to the storage device.

24. The image forming apparatus according to claim 15, further comprising an informing device configured to inform the information stored in the storage device.

25. An image forming apparatus, comprising:

image bearing means for bearing a visual image, the image bearing means including a photosensitive layer and a substrate on which the photosensitive layer is formed;

image forming means for forming a visual image on the image bearing means, the image forming means having charging means for charging uniformly a surface of the image bearing means;

transfer means for transferring the visual image formed on the image bearing means onto a recording medium; and fixing means for fixing the transferred visual image onto the recording medium, wherein assuming that "A" is a thickness of a surface portion of the photosensitive layer abraded by image forming operations of the image forming apparatus, "B" is a thickness of a portion of the photosensitive layer ground by an operation of grinding the abraded surface of the photosensitive layer, "n" is a number of times the operation of grinding the abraded surface of the photosensitive layer has been executed, "C" is an original photosensitive layer thickness of the image bearing means, and "D" is a thickness of a remaining portion of the photosensitive layer after having been ground by the operation of grinding the abraded surface of the photosensitive layer which is obtained by equation:

$$D=C-[(A+B)\times n+A],$$

a relationship between the thickness "A", the thickness "B", the number of times "n", and the original photosensitive layer thickness "C" is set such that the thickness "D" is equal to or greater than a thickness of the photosensitive layer in which leakage from the charging means to the image bearing means does not occur, so that the image bearing means may be reused.

26. The image forming apparatus according to claim 25, further comprising storing means for storing information relating to the image bearing means provided to the image bearing means.

27. The image forming apparatus according to claim 26, further comprising controlling means for reading and revising the information stored in the storing means and for feeding revised information back to the storing means.

28. The image forming apparatus according to claim 26, further comprising reading means for reading the information stored in the storing means.

29. A method of reusing a photoreceptor for an image forming apparatus including a charging device that charges a surface of the photoreceptor, comprising:

grinding an abraded surface of a photosensitive layer of the photoreceptor;

obtaining a thickness of a remaining portion of the photosensitive layer after having been ground by an operation of grinding the abraded surface of the photosensitive layer by equation:

$$D=C-[(A+B)\times n+A],$$

where "A" is a thickness of a surface portion of the photosensitive layer abraded by image forming operations of the image forming apparatus, "B" is a thickness of a portion of the photosensitive layer ground by an operation of grinding the abraded surface of the photosensitive layer, "n" is a number of times the operation of grinding the abraded surface of the photosensitive layer has been executed, "C" is an original photosensitive layer thickness of the photoreceptor, and "D" is a thickness of a remaining portion of the photosensitive layer after having been ground by the operation of grinding the abraded surface of the photosensitive layer; and setting a relationship between the thickness "A", the thickness "B", the number of times "n", and the original photosensitive layer thickness "C" such that the thickness "D" is equal to or greater than a thickness of the photosensitive layer in which leakage from the charging device to the photoreceptor does not occur.

30. The method according to claim 29, wherein the step of setting the relationship comprises setting the thickness "D" to 10 $\mu$m or greater.

* * * * *